United States Patent [19]

Bailey

[11] 4,020,804

[45] May 3, 1977

[54] DIESEL PILE HAMMER WITH VENT FOR STARTING

[75] Inventor: Kenneth E. Bailey, Cedar Rapids, Iowa

[73] Assignee: FMC Corporation, San Jose, Calif.

[22] Filed: Dec. 8, 1975

[21] Appl. No.: 638,397

[52] U.S. Cl. ..... 123/46 R; 123/179 R

[51] Int. Cl.[2] ..... F02B 71/00; F02N 17/00

[58] Field of Search ..... 123/46 R, 46 SC, 46 A, 123/46 H, 179 R; 60/596, DIG. 1; 173/133, 139, 135, 138

[56] References Cited

UNITED STATES PATENTS

| | | | |
|---|---|---|---|
| 2,804,856 | 9/1957 | Spurlin | 123/46 R |
| 3,161,184 | 12/1964 | Koftans | 123/46 H |
| 3,401,755 | 9/1968 | Frederick | 123/46 R |
| 3,437,157 | 4/1969 | Bailey et al. | 123/46 R UX |

*Primary Examiner*—Wendell E. Burns
*Attorney, Agent, or Firm*—J. F. Verhoeven; J. W. Edwards; C. E. Tripp

[57] ABSTRACT

A diesel pile hammer housing is seated upon a pile and a ram moves alternately up and down within the housing, striking an anvil and driving the pile. The ram and the housing cooperate to define a power chamber and a separate scavenging chamber that are interconnected for gases to flow from the power chamber to the scavenging chamber. During the diesel operating cycle, upward movement of the ram creates a sub-atmospheric pressure in the scavenging chamber and gases are drawn from the power chamber into the scavenging chamber. During starting operation, the ram is elevated by a generally cylindrical push rod that fits through a circular guide bushing in the housing to contact the ram within the scavenging chamber. An intermediate portion of the push rod is deformed from its generally cylindrical shape by removal of a segment thereof to form a flat surface along one side of the rod. This deformed portion of the rod and the circular guide bushing define a vent between the scavenging chamber and the atmosphere, as the ram is elevated by the push rod. Thus, atmospheric pressure is maintained in the scavenging chamber, making it easier to lift the ram and to maintain a reed valve in a closed position between the power chamber and the scavenging chamber and thereby retain fresh air in the power chamber. The upper cylindrical end of the push rod forms a seal with the guide bushing during the diesel operating cycle.

7 Claims, 7 Drawing Figures

FIG_1
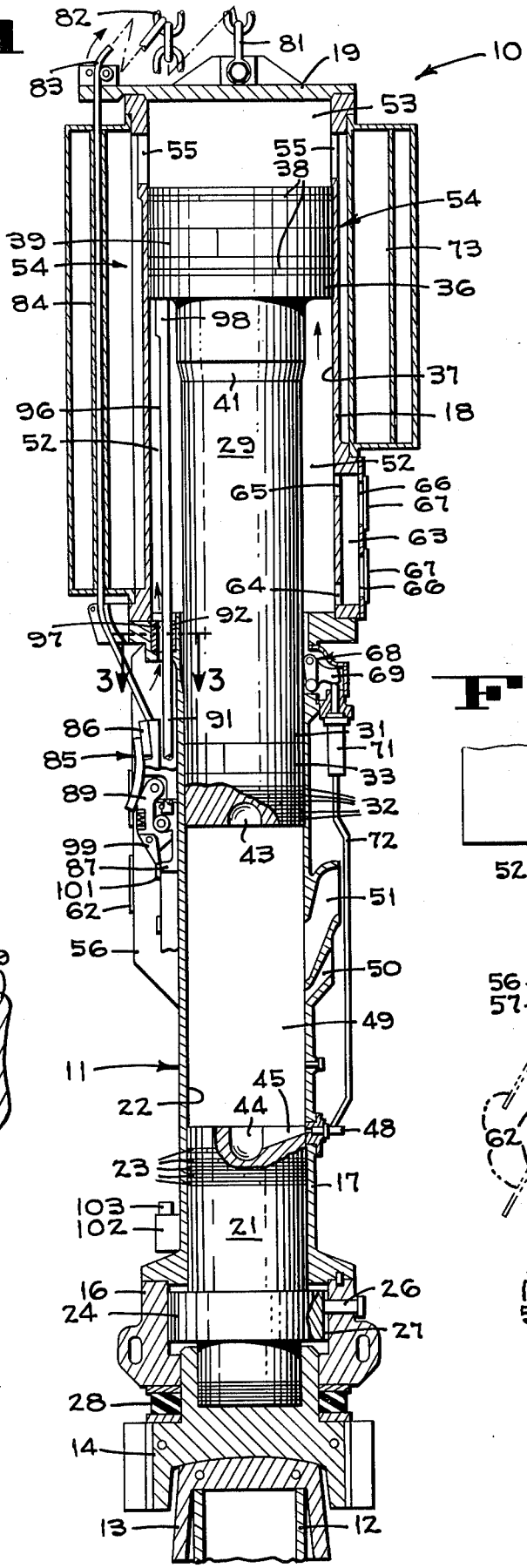
FIG_2
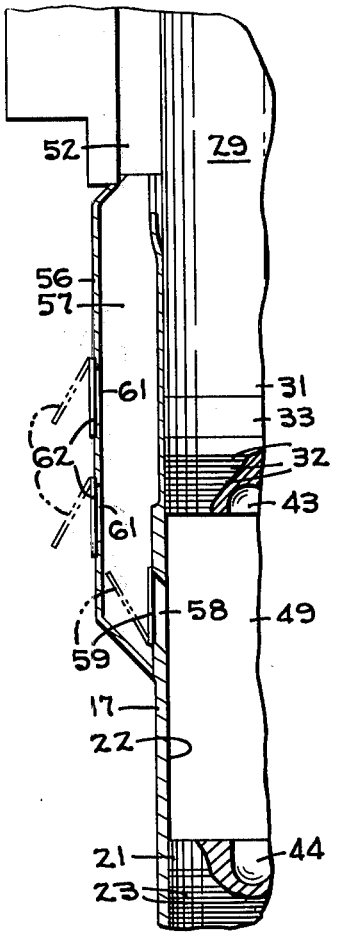
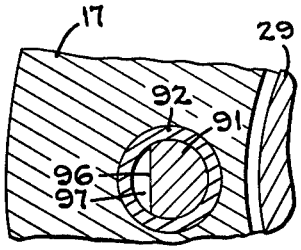
FIG_3

DIESEL PILE HAMMER WITH VENT FOR STARTING

BACKGROUND OF THE INVENTION

1. Field of the Invention

This invention relates to an impacting device for driving piles. More specifically, the invention pertains to a one cylinder diesel engine having a housing adapted to be seated upon a pile and a ram that reciprocates up and down within the housing, striking an anvil and driving the pile.

2. Description of the Prior Art

U.S. Pat. No. 3,437,157 discloses a diesel pile hammer that has a housing and a ram that moves up and down within the housing. The ram and the housing cooperate to define a powder chamber and a separate scavenging chamber. These chambers are interconnected by a passageway with a reed valve therein that limits the flow of gases to the direction from the power chamber to the scavenging chamber. When starting the diesel pile hammer, it is necessary to raise the ram and drop it to obtain the necessary compression of a fuel-air mixture before combustion. A sub-atmospheric pressure is created in the scavenging chamber due to enlargement of the chamber by upward movement of the ram. This pressure makes it more difficult to lift the ram and also allows the reed valve to open. Some fresh air that is drawn into the power chamber by the ram's upward movement is allowed to escape into the scavenging chamber before compression and combustion of the initial starting charge.

SUMMARY OF THE INVENTION

To ensure proper starting of a diesel pile hammer, it is desirable to obtain as much fresh air as possible in a power chamber before compression and combustion of an initial starting charge of fuel-air mixure. Fresh air is retained within a power chamber by venting a separate scavenging chamber to the atmosphere as a ram is elevated to a starting position. Such venting maintains atmospheric pressure in the scavenging chamber, although the scavenging chamber is being enlarged by upward movement of the ram, and the atmospheric pressure in the scavenging chamber maintains a valve in a closed position separating the power chamber from the scavenging chamber.

A ram is slidably disposed for up and down movement within a housing of a diesel pile hammer. The ram and housing cooperate to define a power chamber and a scavenging chamber that are interconnected for gases to flow from the power chamber to the scavenging chamber. The power chamber is vented to the atmosphere and means are provided for raising the ram to a starting position. The scavenging chamber is vented to the atmosphere by a vent as the ram is elevated by the ram raising means. Thus, atmospheric pressure is maintained in the scavenging chamber. Such pressure makes it easier to lift the ram because a vaccum will not be drawing backward on the ram.

BRIEF DESCRIPTION OF THE DRAWINGS

FIG. 1 is a schematic representation of a diesel pile hammer embodying the present invention. A ram within a pile hammer housing is shown elevated to a starting position by a push rod that simultaneously vents a scavenging chamber to the atmosphere.

FIG. 2 is a detail view illustrating in section a conduit that is located between the power chamber and the scavenging chamber of the pile hammer shown in FIG. 1.

FIG. 3 is a section taken on the line 3—3 of FIG. 1.

DESCRIPTION OF THE PREFERRED EMBODIMENT

Figure 4:
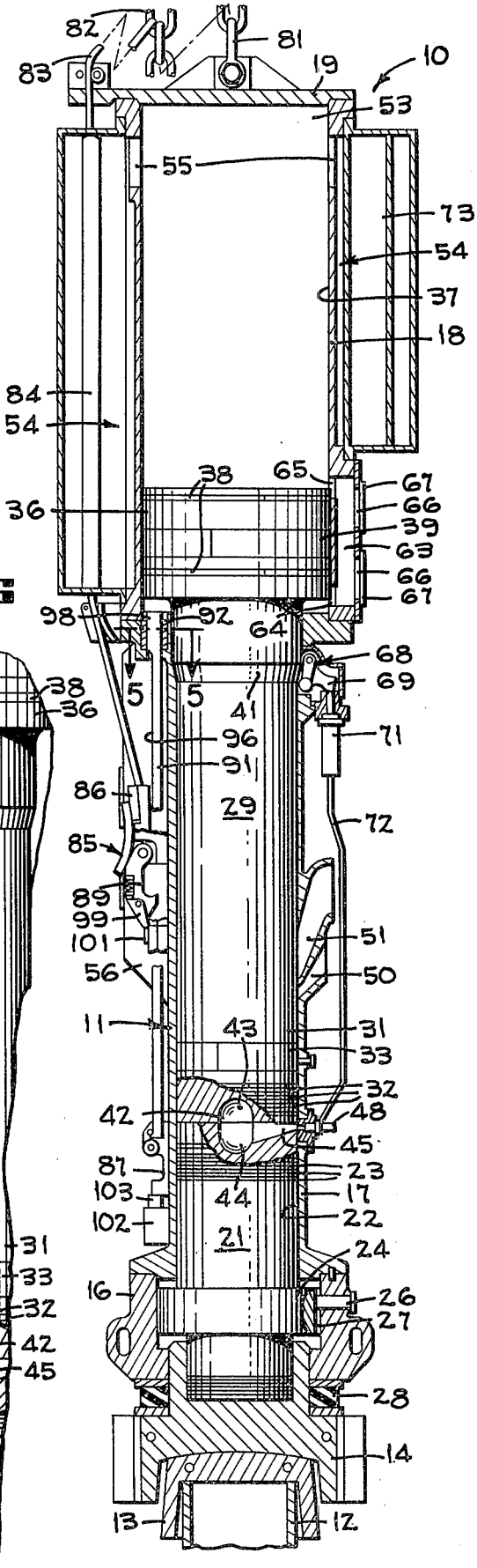
FIG. 4 is a modified schematic representation of the pile hammer shown in FIG. 1. The ram is illustrated in an anvil contacting position and a push rod block is shown in a down position.

Looking now at FIG. 1, a diesel pile hammer 10 has a housing 11 that is adapted to be seated upon a pile 12. A filler 13 rests upon the pile and forms a head for driving the pile. Fitting over the filler is a recoil dampener adapter assembly 14 that serves as a base of the housing. The sidewalls of the housing are formed by an anvil retainer 16, a lower cylinder 17 and an upper cylinder 18. The anvil retainer is mounted upon the adapter assembly with the lower cylinder being mounted on the anvil retainer and with the upper cylinder being mounted on the lower cylinder. A head 19 is mounted on top of the upper cylinder and completes the housing.

Within the housing 11, an anvil 21 closes the lower end of an axial bore 22 in the lower cylinder 17 and the anvil extends through the anvil retainer 16 into the recoil dampener adapter assembly 14. Compression rings 23 are provided on the anvil for sealing the bore of the lower cylinder. A larger diameter portion 24 of the anvil receives bearing support from the anvil retainer and smaller diameter portion of the anvil receives support from the lower cylinder adjacent the bore so that side thrusts tending to cock the anvil are adequately resisted. Such side thrusts can be caused by pile misalignment, eccentricity and whip. The anvil is prevented from rotating during operation within the anvil retainer by an alignment pin 26 fitting through the retainer and projecting into a key slot 27 that is located in the large diameter portion of the anvil. Impact energy from the anvil is transmitted through the recoil dampener adapter assembly and the filler 13 to the pile 12.

An elastomeric ring 28 fits about the outside of the recoil dampener adapter assembly 14 in a position above a lower flange of the assembly and below the anvil retainer 16. This ring absorbs the energy of recoil from the pile 12 as it is being driven and also absorbs the shock from the housing 11 being dropped or bouncing on the pile during operation.

A ram 29 is slidably positioned to reciprocate within the lower cylinder 18 and the upper cylinder 19. The ram has a lower portion 31 in sealing engagement with the bore 22 of the lower cylinder 17. Compression rings 32 and a wear ring 33 are located on the lower portion of the ram. The compression rings prevent leakage of gases through the bore 22 between the lower cylinder wall and the lower portion of the ram. The wear ring acts as a bearing for supporting the ram so that the wall of the lower cylinder 17 does not come into contact with the ram. At the upper end of the ram is a large diameter portion 36 that slidably fits within a bore 37 in the upper cylinder 18. A pair of compression rings 38 and a wear ring 39 are located on this portion of the ram. Below the large diameter portion of the ram is a ram portion having a varied diameter to form a cam surface 41.

A combustion chamber 42, shown in FIG. 4, is formed by a semi-spherical indentation 43 in the bottom of the ram 29 and by a corresponding semi-spherical indentation 44 in the top of the anvil 21. A U-shaped passageway 45 that is open on top extends from the semi-spherical indentaton 44 outward at the anvil upper surface to a fuel injection nozzle 48 that is mounted in the lower cylinder 17. Fuel is injected through the passageway into the combustion chamber when the ram nears its lowermost position. Upon combustion of a fuel-air mixture in the combustion chamber, expanding gases force the ram upward and exert a continuing force downward upon the anvil. A generally cylindrical power chamber 49 is defined within the axial bore 22 of the lower cylinder between the bottom of the ram and the top of the anvil. Gases are retained within the power chamber until the bottom of the ram is elevated to the level of an exhaust port.

A lower intake-exhaust port 50 and an upper intake-exhaust port 51 are located in the lower cylinder 17 and these ports form openings between the power chamber 49 and the atmosphere. Exhaust gases are directed to blow upward from these ports into the atmosphere. The ports are shaped to direct fresh air that is drawn inward through the ports to flow down towards the anvil and sweep burned gases out of the power chamber during scavenging. These ports are located in a position to be the first ports opened as the ram 29 raises on the power stroke.

The bore 37 of the upper cylinder 18 is divided by the large diameter portion 36 of the ram 29 into a scavenging chamber 52 and a bounce chamber 53. The scavenging chamber is located below the ram's large diameter portion and the bounce chamber is located above that portion of the ram. An auxiliary bounce chamber 54 is defined by the exterior of the housing 11 about the upper cylinder 17 and a port 55 opens through the upper cylinder wall between the bounce chamber and the auxiliary bounce chamber. During the upward stroke of the ram 29, air compressed within the bounce chamber overflows into the auxiliary bounce chamber. If the ram moves past its normal uppermost position, it closes off the port 55 and enters a space in the top of the bounce chamber where air is confined. Such confined air is rapidly compressed by the ram and retards further upward ram movement to prevent the ram from striking the cylinder head 19.

A conduit 56 is mounted on the outside of the lower cylinder 17 and extends to the upper cylinder 18. As shown in FIG. 2, the conduit forms a scavenging passageway 57 between the power chamber 49 and the scavenging chamber 52. A port 58 in the lower cylinder wall has an internal scavenge valve 59 mounted thereon to pivot outwardly from the cylinder wall, as indicated in phantom line, allowing gases to flow from the power chamber to the scavenging passageway. External scavenging ports 61 are provided in the conduit and these ports are covered by outwardly pivoting reed valves 62 that enable scavenging gases to pass from the scavenging passageway outwardly to the atmosphere.

Looking again at FIG. 1, a conduit 63 is mounted on the outside of the upper cylinder 18. A lower port 64 and an upper port 65 provide flow communication between the conduit and the interior of the upper cylinder. External scavenging ports 66 are provided in the conduit and these ports are covered by reed valves 67 that enable the conduit to be vented to the atmosphere when pressure within the conduit exceeds atmospheric pressure. Valves 62 and 67 act simultaneously and in the same manner. As the large diameter portion 36 of the ram 29 descends, a slight positive pressure is created in the scavenging chamber 52. As the ram approaches the bottom of its stroke, the top of the large diameter portion 36 clears the port 65. Gases by-pass the ram's large diameter portion by flowing from the scavenging chamber 52, through the port 64, the conduit 63, and the port 65 into the bounce chamber 53. Any air lost in the bounce chamber during compression of gases on the up stroke is made up at this time on the downstroke and the bounce chamber is restored to about atmospheric pressure.

To feed fuel at the proper time to the combustion chamber 42, a cam follower 68 is located on the lower cylinder 17 to engage the cam surface 41 on the ram 29, as shown in FIG. 4. A lever 69, projecting from the cam follower, contacts a fuel pump 71 so that diesel fuel is pumped through a line 72 to the nozzle 48. This nozzle injects fuel into the combustion chamber. Fuel is supplied to the pump from a diesel fuel tank 73 that is mounted on the outside of the upper cylinder 18.

A handling chain 81 is connected to the center of the upper cylinder head 19, as shown in FIGS. 1 and 4, and leads to a handling eye 82. A suitable lifting means, such as a crane, can be attached to the handling eye for moving the diesel pile hammer 10, positioning the hammer on a pile 12, and lifting the ram 29 to start the diesel pile hammer in operation. A flexible wire rope 83 is connected to the handling eye and extends through a tubular guide 84 in the bounce chamber 54 that is located outside of the upper cylinder 18 to a ram lifting mechanism 85 on the lower cylinder 17.

Figure 6:
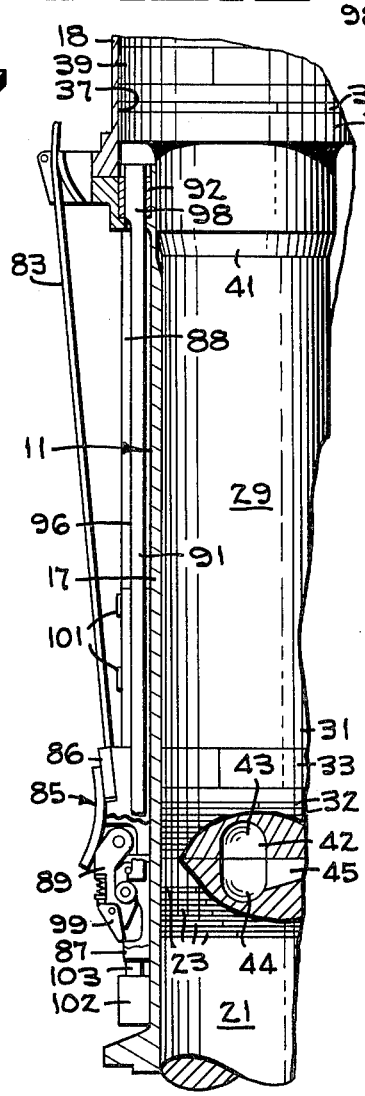
FIG. 6 is a fragmentary operational view of the pile hammer that illustrates the push rod block engaged by a hook for starting operation.

The ram lifting mechanism 85 includes a hook block 86, connected to the flexible wire rope 83, and a push rod block 87 that can be coupled to the hook block. Both blocks are slidable vertically upon the lower cylinder 17 within a pair of ways 88, shown in FIG. 7. The hook block is positioned above the push rod block and has a hook 89 for engaging the push rod block, as shown in FIGS. 1 and 6. The hook block can also move independently of the push rod block, as shown in FIG. 4. A push rod 91 extends upward from the push rod block through an opening in a circular guide bushing 92. This bushing is located within a bore in a connecting flange of the lower cylinder 17 and the upper cylinder 18 overlaps the bushing slightly to retain the bushing in place within the bore. Within the scavenging chamber 52, the push rod engages the under side of the ram's large diameter portion 36 when the push rod block is elevated, as shown in FIG. 1.

Figure 5:
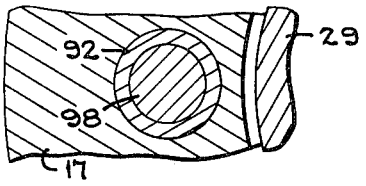
FIG. 5 is a sectional view taken on the line 5—5 of FIG. 4.

An intermediate portion of the push rod 91 is deformed from its generally cylindrical shape by the removal of a segment thereof to form a flat surface 96 along one side of the rod. As the ram 29 is elevated by the push rod, the deformed portion of the rod and the circular guide bushing 92 define a vent 97 (shown in FIGS. 1 and 3) that is located between the scavenging chamber 52 and the atmosphere outside the housing 11. An upper end 98 of the push rod has a circular cross section, as shown in FIG. 5, and this upper end of the rod fills the opening in the guide bushing to prevent air leakage between the scavenging chamber and the atmosphere when the push rod is in a lowered position, as shown in FIG. 4.

A trip lever 99 is pivotally mounted upon the hook 89. This trip lever is spring loaded to maintain a generally straight or in-line relationship with the hook. Release blocks 101 are mounted upon one of the ways 88, on the lower cylinder 17, in a position to be engaged by the trip lever when the hook block 86 descends, as shown in FIG. 1. Upon such engagement, the trip lever and hook act as a toggle linkage, with the hook pivoting outwardly to disengage the push rod block 87. Such outward pivoting of the hook also causes the trip lever to disengage from the release block. This allows the hook block, push rod 91, and ram 29 to be accelerated downward by gravity and the bounce chamber pressure acting upon the top of the ram. When the hook block 86 is elevated, the trip lever ratchets over the release blocks.

Figure 7:
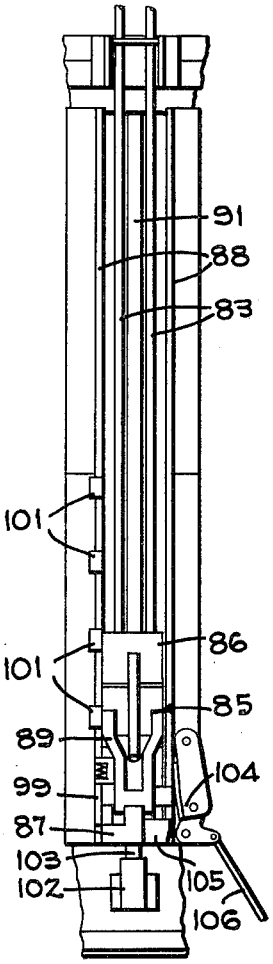
FIG. 7 is a side elevation view of the pile hammer fragment shown in FIG. 6.

A dash pot 102 is mounted on the lower cylinder 17 below the ways 88. A plunger 103 projects upwardly from the dash pot to engage the push rod block 87 when it drops after being released from the hook block 86. The dash pot is a conventional dash pot that contains a spring and hydraulic fluid to resist inward movement of the plunger in response to impact with the push rod block. After the fall of the push rod block has been broken by the dash pot, the block can be locked in a down position. A spring loaded toggle linkage 104, as shown in FIG. 7, is mounted on the lower cylinder for the upper link of the linkage to pivot laterally over a stop 105 on the push rod block and hold the push rod block in a down position. The spring loaded toggle linkage has a ground line 106 attached to the lower link which is the spring loaded link. The toggle linkage can be released from the stop 105, as shown in FIG. 7, by pulling on the ground line.

To start the diesel pile hammer 10 in operation from the position shown in FIG. 4, the handling eye 82 is lowered and the flexible wire rope 83 allows the hook block 86 to descend toward the push rod block 87. As the hook block approaches the push rod block, the ground line 106 is pulled to release the upper link of the spring loaded toggle linkage 104 from the stop 105. The push rod block is released from its locked position and the hook 89 is allowed to engage the push rod block, as shown in FIGS. 6 and 7. The handling eye is then raised, lifting the wire rope, hook block and push rod block. The trip lever 99 ratchets over the release blocks 101 so that the hook block and push rod block remain coupled as they are lifted. As the push rod 91 is elevated, it engages the bottom of the large diameter portion 36 of the ram 29 and raises the ram with it.

As the push rod 91 raises the ram 29, a vent 96, shown in FIGS. 1 and 3, is formed between the circular guide bushing 92 and the flat surface 96 on the push rod to provide gas flow communication between the scavenging chamber 52 and the atmosphere outside the housing 11. Raising the ram enlarges the scavenging chamber and tends to create a sub-atmospheric pressure therein but the vent allows air from the atmosphere to pass beside the push rod into the scavenging chamber and maintain atmospheric pressure therein. Thus, atmospheric pressure is maintained in the scavenging passageway 57 and the internal scavenge reed valve 59 remains closed, as shown in FIG. 2. Fresh air is drawn into the power chamber 49 through intake-exhaust ports 50 and 51 and the internal scavenge reed valve retains the fresh air in the power chamber as the ram 29 is elevated. Since atmospheric pressure is maintained in the scavenging chamber, it is easier to elevate the ram because a vacuum will not be drawing backward on the ram.

The handling eye 82 is raised until either the handling chain 81 becomes taut or else the upper end of the hook block 86 engages the coupling flange at the top of the lower cylinder 17. In either instance, further upward movement of the handling eye would raise the entire diesel pile hammer 10. The handling eye is then lowered, allowing the flexible wire rope 83, hook block 86, push rod block 87, and ram 29 to descend. After the trip lever 99 engages a release block 101, the hook 89 pivots outward and disengages from the push rod block, allowing the ram 29 and push rod block to drop.

As the ram 29 starts downward, accelerated by gravity, the internal scavenge reed valve 59 is closed. The push rod vent 97 allows the scavenge air to escape to atmosphere without the slight pressure buildup necessary to open the external scavenge reed valves 62 and 67. Thus, the ram's descent is not retarded initially and pressure builds up rapidly to open the reed valves. Air is discharged from the scavenging chamber 52 through the vent 97 and through the external scavenging reed valves 62 and 67. As the ram continues to move downward, the lower intake-exhaust port 50 is sealed by the ram. Thereafter, air is compressed in the power chamber 49 between the ram bottom 34 and the top of the anvil 21. Further downward movement of the ram causes the top of the ram to open the port 65 and restore the bounce chamber 54 to atmospheric pressure by gases flowing thereto from the scavenging chamber 52. The cam follower 68 engages the cam surface 41 and the lever 69 operates the fuel pump 71, through a tappet causing diesel fuel to be pumped to the nozzle 48 which injects the fuel into the combustion chamber 42.

The bottom of the ram 29 strikes the top of the anvil 21, as shown in FIG. 4, and the charge of fuel air mixture in the combustion chamber 42 is ignited. The push rod block 87 drops with the ram and strikes the plunger 103 that projects from the dash pot 102. The impact of the push rod block is cushioned by the dash pot and the push rod block is locked in a down position by the upper link of the spring loaded toggle linkage 104 that pivots laterally over the stop 105. The upper end 98 of the push rod 91 fits within the circular guide bushing 92 and seals that opening in the scavenging chamber 52 for normal operation of the diesel pile hammer 10. The hook 89 is normally held in a mid position, as shown in FIG. 4, after releasing the push rod block.

The normal operation cycle of the diesel pile hammer 10 after starting is similar to that described in U.S. Pat. No. 3,437,157, from column 8, line 60 to column 9, line 18, and with reference to FIGS. 16–21. That description is incorporated herein by this reference.

From the foregoing description, it will be seen that the vent 97 located between the scavenging chamber 52 and the atmosphere opens in respnse to elevating the ram 29 for starting the diesel pile hammer 10. Atmospheric pressure in the scavenging chamber makes it easier to lift the ram and also retains fresh air in the power chamber 49. As the ram drops, compressing the air in the power chamber, the vent exhausts gases from the scavenging chamber and enables the ram to drop faster. When the push rod 91 is in a down position, the vent is sealed for normal operation of the diesel pile hammer.

Although the best mode contemplated for carrying out the present invention has been herein shown and described, it will be apparent that modification and variation may be made without departing from what is regarded to be the subject matter of the invention.

What is claimed is:

1. In a diesel pile hammer having a housing, a ram being slidably disposed within the housing and cooperating with the housing to define a scavenging chamber and a power chamber, means interconnecting said scavenging chamber with said power chamber for gases to flow from the power chamber to the scavenging chamber, said housing having at least one port therein between the atmosphere and the power chamber, and means for raising the ram to a starting position, the improvement comprising means for venting the scavenging chamber to the atmosphere as the ram is elevated by the ram raising means.

2. In a diesel pile hammer, the combination comprising a housing, a ram being slidably disposed within the housing and cooperating with the housing to define a scavenging chamber and a power chamber, means for providing gas flow communication in a direction from the power chamber to the scavenging chamber, means for raising the ram to a starting position, and means for venting the scavenging chamber to atmosphere as the ram is elevated by the ram raising means.

3. The combination described in claim 2 wherein said scavenging chamber venting means are actuated by movement of the ram raising means relative to the housing.

4. The combination described in claim 3 wherein said ram raising means includes a push rod that fits through a circular opening in the housing and extends into the scavenging chamber to contact the ram, said push rod having a generally cylindrical shape with a segmental deformation along an intermediate length of the rod, and wherein said scavenging chamber venting means includes the segmental deformation on the push rod and the circular opening in the housing.

5. In a diesel pile hammer, the combination comprising a housing, a ram being slidably disposed within the housing for up and down reciprocation therein, said ram having portions cooperating with the housing to define a scavenging chamber and a power chamber, said housing having a port located between the power chamber and the atmosphere outside the housing for taking air into the power chamber, a conduit connecting the power chamber to the scavenging chamber, a one-way valve associated with the conduit for limiting the flow of gases through the valve to a direction from the power chamber to the scavenging chamber, said ram forming movable walls for both the power chamber and the scavenging chamber whereby upward movement of the ram increases the volume of both chambers and thereby reduces the pressure in each chamber until air is drawn from the atmosphere through the power chamber to the scavenging chamber during normal operation of the pile hammer, means for raising the ram to a starting position, and means for venting the scavenging chamber to the atmosphere as the ram is elevated by the ram raising means to the starting position.

6. The combination described in claim 5, wherein said ram raising means includes a rod that is slidably mounted on the outside of the housing for movement parallel to the reciprocation of the ram, said housing having an opening therein for the rod to extend through into the scavenging chamber, said rod being adapted to contact the ram portion that forms a movable wall for the scavenging chamber and to impart an elevating force thereto, said rod having a deformation along an intermediate length of the rod, and wherein said scavenging chamber venting means includes the deformation along the intermediate length of the rod and the rod opening in the housing, said deformation and rod opening being aligned with each other to define a vent as the rod is elevated to raise the ram.

7. The combination described in claim 6 wherein said rod has a generally cylindrical shape with said deformation removing a segmental portion thereof to form a flat surface along an intermediate portion of the rod and said rod opening in the housing has a circular cross-section.

* * * * *